US006823532B1

(12) United States Patent
Anderson

(10) Patent No.: US 6,823,532 B1
(45) Date of Patent: Nov. 30, 2004

(54) MALODOR CONTROL SYSTEMS FOR TOILETS

(76) Inventor: Donald C. Anderson, 58 Ashbrook Pl., Moraga, CA (US) 94556

( * ) Notice: Subject to any disclaimer, the term of this patent is extended or adjusted under 35 U.S.C. 154(b) by 0 days.

(21) Appl. No.: 10/611,303

(22) Filed: Oct. 20, 2003

(51) Int. Cl.[7] ..... E03D 9/05
(52) U.S. Cl. ..... 4/215; 4/217
(58) Field of Search ..... 4/215, 217

(56) References Cited

U.S. PATENT DOCUMENTS 776,815 A * 12/1904 Sullivan et al. ..... 4/215
3,659,296 A * 5/1972 Stamper ..... 4/217

* cited by examiner

*Primary Examiner*—Robert M. Fetsuga
(74) *Attorney, Agent, or Firm*—Edmund S. Lee, III

(57) ABSTRACT

A malodor control system for a toilet comprises a modified toilet seat which is a hollow construction. The seat may be mounted on supports for pivotal movement between an up position and down position in which its opening is registered with the opening of an toilet bowl for receiving products of human waste. As in conventional toilets, portions of a person sitting on the seat define a chamber, in combination with the seat and the bowl. A pair of water spray nozzles are disposed within the hollow seat and directed rearwardly toward the pivotal mounting for the seat. A water supply system includes a flexible tube connection between a fixed source of pressurized water and a bracket for pivotally mounting the seat. Flow of water to the spray nozzles is controlled by a valve on the rear of the seat. The water spray induces flow of fouled air from the user defined chamber into the hollow seat where offensive odors are removed by the water spray. Entrainment separators, downstream of the spray nozzles, precipitate water from the air. The water is then returned to the toilet bowl, while the clensed air is discharged from the seat. An air freshener unit, downstream of the entrainment separator further additionally treats the air to make it more pleasant.

19 Claims, 5 Drawing Sheets

24
16
20
38
26
37
40
66
86
62
64
36
60
22
18

108
102
104
44
96'
98
106
35
36
37
40
42
34
38
5
b
3
52
46
48
a
6
42
50
5
44
36
114
56
7
96
41
30
32
8
26
39
112
110
a
94
6
64
66
86
94
7
49

FIG 3
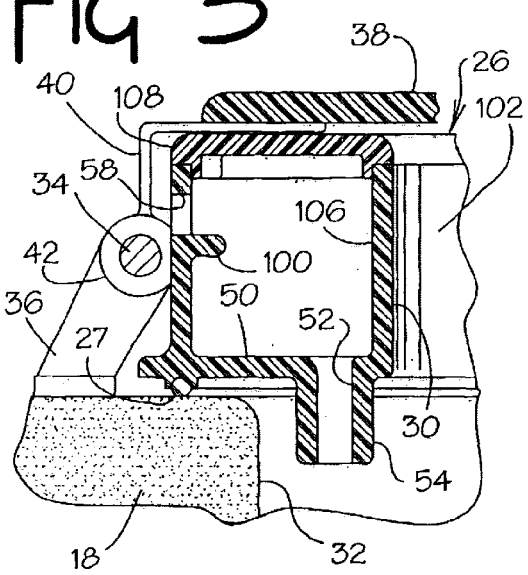
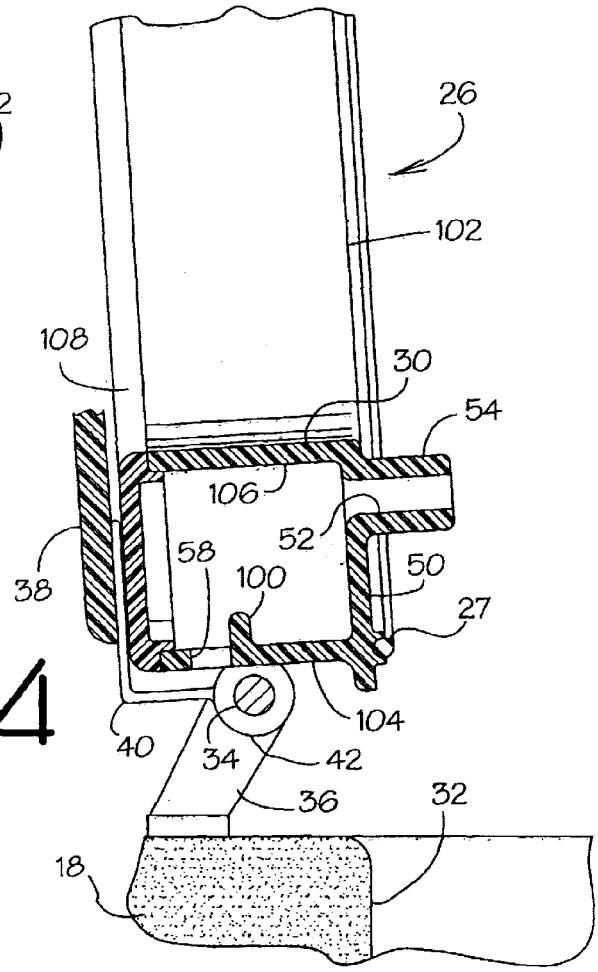
FIG 4
FIG 5
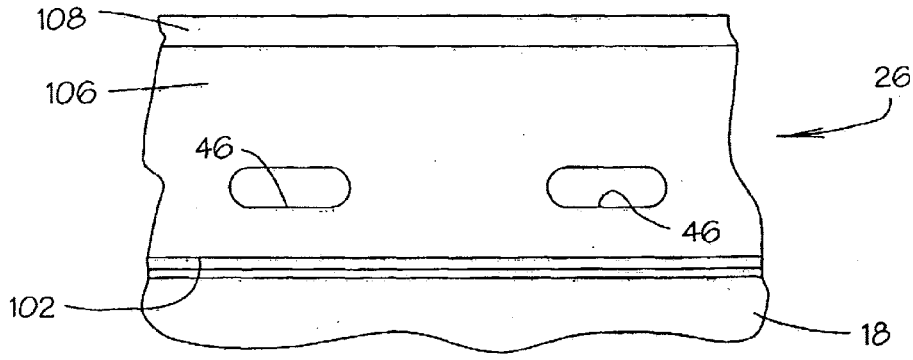

MALODOR CONTROL SYSTEMS FOR TOILETS

The present invention relates to improvements in the art of minimizing the penetrating, foul odor that is so frequently incident to the bodily function of defecation.

There have been many prior art proposals to deal with bathroom malodor. For the most part these proposals have involved, in one fashion or another, the provision of venting means for exhausting fouled air from the lavatory in which a toilet is situated. My prior U.S. Pat. No. 5,530,971 departs from these conventional approaches through the use of a water spray disposed in a u-shaped tube adjacent and above the toilet seat. The water spray draws fouled air from a toilet causing it to pass through the fine droplets of the spray. The water absorbs the foul odors of air from the toilet bowl, permitting it to be recirculated within the ambient atmosphere of the lavatory, while the water is returned to the toilet bowl for disposal when the toilet is flushed.

The object of the present invention is to incorporate the operative components of water spray malodor system into a toilet seat to the end that the advantages of water droplet absorption are more widely enjoyed. This is to say that by modifying the conventional toilet seat rather than requiring a separate and independent unit, as previously proposed, use of the spray malodor absorption becomes more attractive to a broader spectrum of people.

Another object is to incorporate the operative components of a water spray, malodor absorption system in a toilet seat in a fashion permitting retention of the conventional ability to pivot the seat to an "up" position in which the seat is offset rearwardly of the toilet bowl opening. Additionally it is desired to preserve the ability of having a lid which is pivotal between an "up" position rearwardly of the seat opening and a closed position in which the lid overlies the seat opening.

A further object of the invention is to facilitate retrofitting existing toilets with the capability of providing a water spray malodor absorption capability.

Another object of the present invention is to improve the effectiveness of water spray malodor absorption systems.

Yet another object of the invention is to attain the foregoing ends in an economical fashion.

These objectives may be broadly attained by the combination of a toilet bowl and a seat having an opening generally aligned with the bowl opening. The seat and bowl, in combination with the body of a person sitting on the seat, form a chamber. A malodor control system comprises means defining a fluid flow path within the seat. The flow path has an inlet opening communicating with this chamber and an outlet for discharging air from the flow path to the exterior of the seat. A water spray nozzle disposed in the flow path, between these openings, draws fouled air from the chamber into the flow path, so that the fouled air will be scrubbed with water droplets, and then returned to the ambient atmosphere. The fluid flow path additionally has a water discharge through which water from the spray is returned to the toilet bowl.

Other features of the invention are found in the provision of an entrainment separator, which is disposed in the fluid flow path downstream of the nozzle and precipitates water from the air flowing through the flow path. The water discharge opening is then disposed downstream of the entrainment device. Further control over malodor may then be attained by the provision of an air freshener unit disposed in the flow path, downstream of the entrainment separator.

Preferably the seat is pivotally mounted on the toilet bowl and includes means for supplying water to the spray nozzle. The water supply means then include a flexible water line connecting a rear portion of the seat to a fixed source of pressurized water. Actuation of the malodor control is preferably controlled by a valve, mounted in the seat and manually operated to initiate discharge of water from the nozzle. Advantageously, the mounting means for the toilet seat include a bracket secured to a rear portion of the seat. This bracket has an extension aligned with the axis of pivotally movement and projecting laterally outwardly of the seat. The water supply means include a passageway extending lengthwise of the bracket extension and the flexible tube is secured to said extension and in fluid communication with the lengthwise extending passageway.

Where there is a horizontally disposed rim peripherally of the opening into the toilet bowl, it is preferred to mount sealing means on the lower surface of the seat. The sealing means engage the upper surface of the bowl rim so as to positively seal the juncture of these two components of the chamber which is defined in part by portions of the body of the person sitting on the seat.

In accordance with another aspect, the ends attained by the present invention may be broadly attained by a toilet having an upwardly open bowl having a rim defining a bowl opening in combination with a hollow seat having an opening generally aligned with the bowl opening so that these components and portions of the body of a person sitting on the seat form a chamber. A malodor control system comprises a pair of water spray nozzles disposed within the seat, on opposite lateral sides thereof. Inlet means are provided in the hollow seat for placing the interior of the seat into communication with said chamber. Air discharge means are formed in the seat downstream of the spray nozzles for placing its hollow interior in communication with ambient air exteriorly of the chamber. Water discharge means are formed in a bottom wall portion of the seat for placing its hollow interior in communication with said chamber to return water from the spray nozzles to the toilet bowl.

In the hollow toilet seat which is pivotally mounted on the bowl, a preferred arrangement is to dispose the water spray nozzles therein toward the free end thereof and directed rearwardly toward the pivotally mounted end. The water discharge means may then take the form of an opening in the bottom wall of the seat adjacent the pivotally mounted end of the seat. The upper surface of the bottom wall of the seat is then sloped downwardly from the nozzles to the discharge opening to assure drainage of water from the seat. Preferably the discharge means opening is formed through a tube that projects below the level of the bottom wall of the seat in order to guard against flow of discharged water along the lower surface of the seat and onto the upper surface of the bowl.

In forming a hollow seat it is preferred that it comprise an upper portion which is removably secured to a lower portion to thereby provide ready access into the interior of the seat. This then enables installing of a new air freshener unit when the previous air freshener unit has lost its effectiveness, as well as facilitating repair and/or replacement of the nozzles or entrainment separator. Another preferred constructional feature is found in connecting the pivotal mounting means to the lower portion of the hollow seat.

Another preferred aspect of the invention is found in maximizing the rate of fouled air flow through the seat. This flow rate is a function of velocity and volume of water flow. Fouled air flow rate is also a direct function of cross sectional area of the fouled air flow path. It is for this reason that the toilet seat preferably has a height substantially greater than the usual toilet seat. It has been found that minimum flow area, at least in the region of the spray nozzles should be at least in the approximate order of 6.25 square inches. It is further preferred, that there be a single nozzle for each fouled air flow path and that the height of the flow path approximate the width of the flow path to better conform with the conical spray pattern.

The above and other related objects and features of the invention will be more fully apparent from a reading of the following disclosure, having reference to the accompanying drawings, and the novelty thereof pointed out in the appended claims.

IN THE DRAWINGS

FIG. 3 is a section, on an enlarged scale, taken on line 3—3 in FIG. 2;

FIG. 4 is a section, on an enlarged scale, also taken on line 3—3 in FIG. 2, illustrating the toilet seat in its raised position;

FIG. 5 is a development view taken on line 5—5 in FIG. 2;

Figure 1:
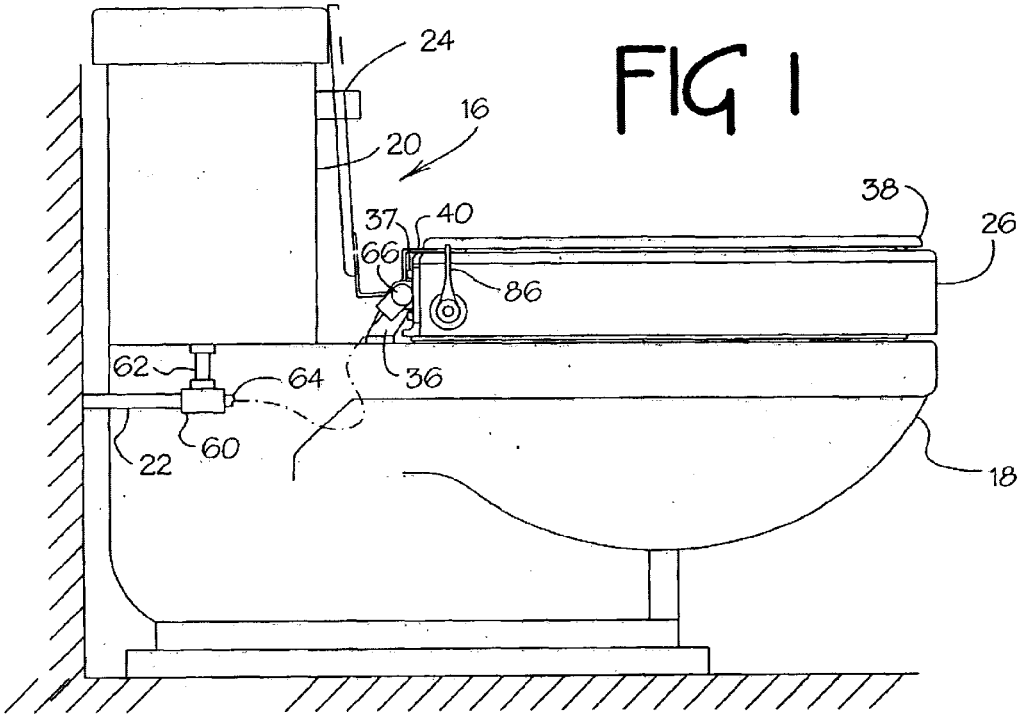
FIG. 1 is a side view of a toilet embodying the present invention.

Reference is first made to FIG. 1, and a toilet which is generally indicated by reference character 16. The waste elimination components of the toilet 16 may be of conventional construction, comprising an upwardly open ceramic bowl 18 and a water tank 20. Water is provided to the tank 20 from a pipe 22, with flow of water into the tank being controlled by a valve within the tank, in known fashion. Flushing of elimination products from the tank, may be actuated, by manual rotation of a lever 24, again in conventional fashion.

The novelty of the present invention is found in a toilet seat 26, which is provided in lieu of a conventional toilet seat. The toilet seat may of generally ovate outline, more or less matching the ovate outline of the toilet bowl, and has a central opening 30 which is aligned with the opening 32 of the toilet bowl 18. The rear portion (towards the water tank 20) of the seat 26 is pivotally mounted on a pin 34, which is carried by supports 36. The supports 36 may be mounted in the same holes that are normally provided in toilet bowls for the supports on which a conventional toilet seat would be pivotally mounted. Also in conventional fashion, the supports 36 may have a lower threaded portion onto which a nut 33 is threaded (FIG. 8) to engage an underlying portion of the bowl 18 and secure the supports in place.

A bracket 35 is secured by screws 37 to one lateral side of the seat 26 and pivotally receives one end of the shaft 34, extending beyond the adjacent support 36. A second bracket 39 is secured by screws 41 to the opposite side of the seat 26 and pivotally receives the opposite end portion of the shaft 34, see also FIG. 9. A toilet seat lid 38 is also pivotally mounted on the pin 34, having brackets 40 which angle down to integral collars 42 that are mounted on the pin 34.

The present invention thus provides for the lid 38 to be raised independently of the seat 26, as indicated in FIG. 1, or both the seat an lid may be raised as a unit, having reference to FIG. 4. Thus the conventional functions of a toilet seat and toilet seat lid are preserved.

The present invention is primarily operative during the process of defecation, when a person is sitting on the seat 26. The seat, of course is in its down position, resting on the upper surface of the toilet bowl 1.8. Thus, the buttocks and thighs of the person essentially seal off the upper end of the toilet seat opening 30 to an extent that is directly proportional to the bulk of the person. Thus an essentially closed chamber can be created, being defined by the toilet bowl, the water in the toilet bowl, the central opening in the seat 26 and the body of the person on the seat. To further explain this point—a person of slight build, best exemplified by a youngster just beyond the toilet training stage, would block off a relatively small portion of the toilet seat opening 30 and, from a practical standpoint, a closed chamber will not be formed. For such a small person, there will be reduced benefits from the present invention.

The lower surface of the seat 26 is provided with a recess in which a endless sealing ring 27 is positioned (FIGS. 3, 6, 7 and 8). The ring 27 extends around the seat opening 30 and sealingly engages the upper surface of the toilet bowl, peripherally outwardly of the bowl opening 32. Therefore, when a person, is sitting on the seat 26, a positive seal is obtained between the seat and the toilet bowl to thereby maximize the sealing of the cavity defined by the toilet bowl and the user sitting on the seat.

Figure 2:
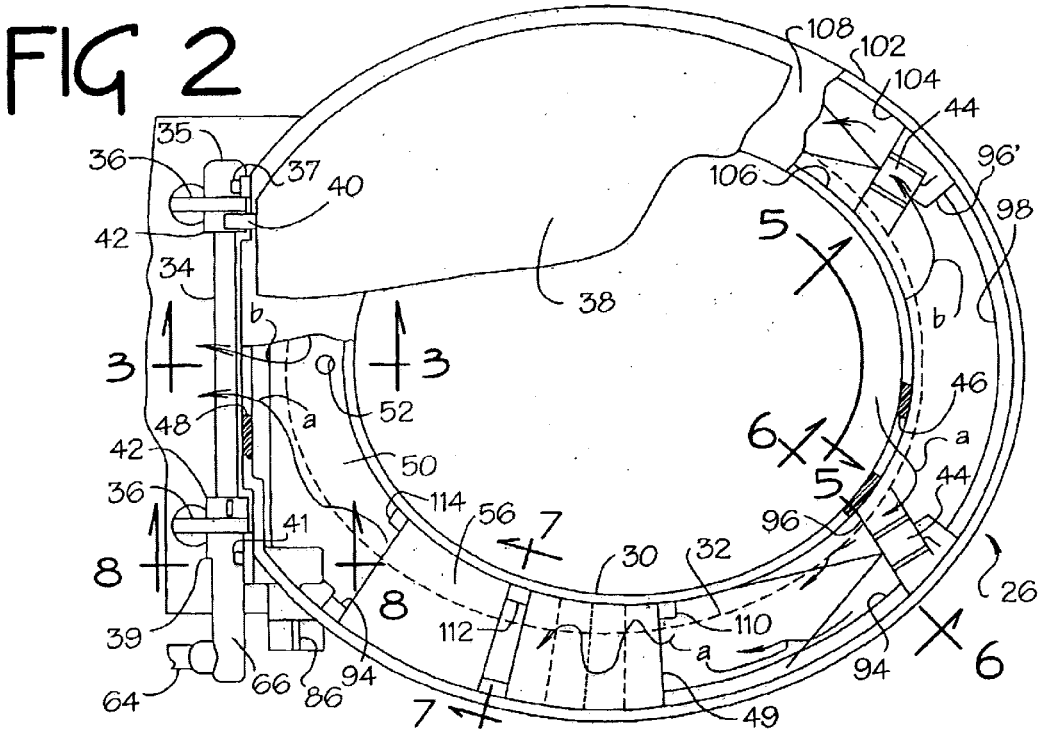
FIG. 2 is a plan view, with portions broken away and in section, of the toilet seen in FIG. 1.

The end served by the provision of a closed chamber is to maximize the flow of fouled air from the toilet bowl chamber to and through a passageway interiorly of the seat 26. As this fouled air passes through the seat passageway, it is subjected to a scrubbing action as it passes through a water spray. Actually, and preferably, there are two passageways through which the fouled air passes, one on each lateral side of the seat 26 (FIG. 2). The water spray is provided by nozzles 44, disposed, respectively on opposite lateral sides of the seat 26. The velocity of the water discharged from the nozzles 44 creates a reduction in pressure upstream of the nozzles. This partial vacuum draws fouled air from the interior of the bowl 26 through inlet openings 46 formed in the front portion of the seat opening 30, see also FIG. 5.

The fouled air is intimately intermixed with the fine droplets of water discharged from the nozzles 44, thus enhancing the scrubbing action whereby malodors originating within the toilet bowl, are absorbed by the water. The toilet bowl air is thereby rendered substantially free of any stench as it is discharged into the ambient atmosphere through an outlet opening 48 in the rear portion of the seat 26.

Downstream of each nozzle 44, there is an entrainment separator 49 which functions to precipitate water entrained in the fouled air. The separator may take many different forms, and will comprise a tortuous path definition providing a large contact surface area on which the flowing air will impinge to the end that the water droplets will be precipitated therefrom and fall by gravity to the upper surface of the lower seat wall 50 of the passageway through the seat 26. The entrainment separator also assists in the deodorizing function, in that it is a meshed or reticulated device having a large surface area. When this surface area becomes wetted by the impingement of water droplets thereon, the greatly increased water surface area enhances absorption of malodor as the fouled air passes thereover.

Figure 6:
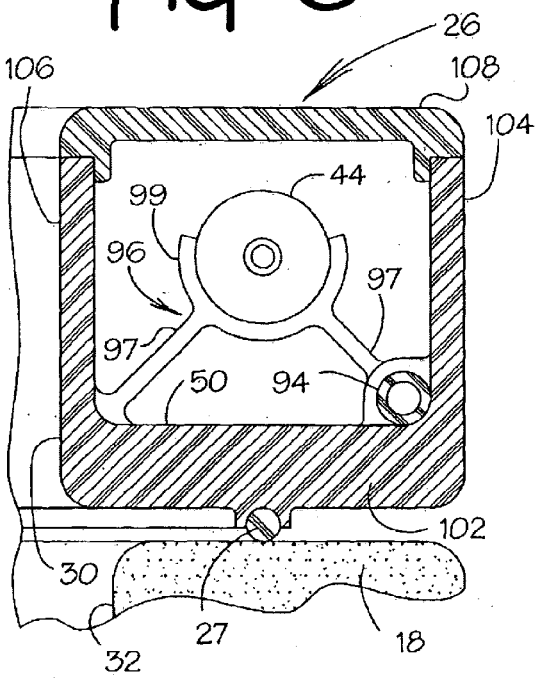
FIG. 6 is a section, on an enlarged scale, taken generally on line 6—6 in FIG. 2.
Figure 7:
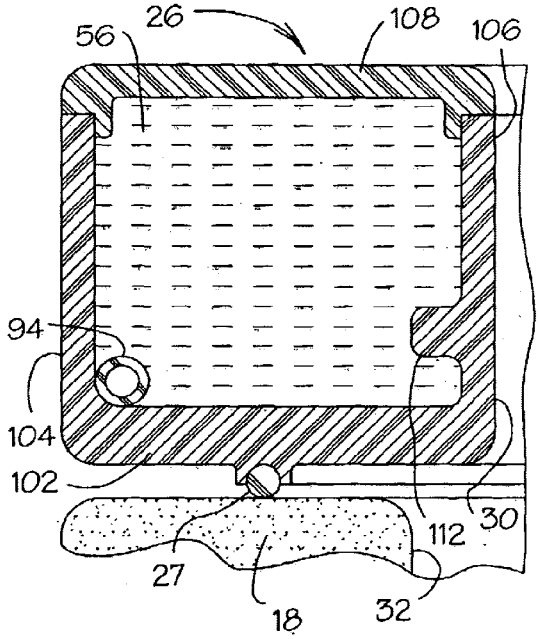
FIG. 7 is a section, on an enlarged scale, taken generally on line 7—7 in FIG. 2.

The lower surface of the seat passageway is sloped downwardly from the front of the seat to the rear of the seat, as is evidenced from FIGS. 6, 7 and 3. A discharge opening 52 is then provided in the low part of the seat passageway. Preferably the discharge opening 52 is by way of a tubular extension 54 of the lower wall of the seat in order to assure that the discharged water will flow directly into the toilet bowl 18, and not be drawn to the upper surface of the bowl.

Additional assurance of odor free air being returned to the ambient atmosphere may be had through the provision of an air freshener unit 56 downstream of each of the entrainment separators 49. The air freshener units may include activated charcoal and/or other agents that have some effectiveness in minimizing any remaining odor bodies, with or without the addition of a scenting agent that would additionally function to mask disagreeable odors incidental to the defecation process.

After passing through the air freshener unit 56, air is then discharged through the air discharge opening 48 in the rear wall of the hollow seat 26. The air thus discharged is substantially free of unpleasant odors, whereby the ends sought by the present invention are attained.

Water may be supplied to the nozzles 44 by the simple expedient of mounting a T-connecter 60 to the pre-existing pipe 22. A pipe 62 then supplies water to the toilet tank 20 and a flexible hose 64 supplies water to the seat 26. Flexible hose 64 is connected to an extension 66 of the bracket 39 providing pressurized water to a passageway 68 extending axially of the extension 66, and preferable coaxially of the pin 34 (FIG. 9). The passageway 68 communicates with a forwardly extending passageway 70, compositely formed in the bracket extension 66 and an enlarged portion 72 of the seat 26. The passageway 70 communicates with a vertical passageway 74, formed in the enlarged seat portion 72, see also FIG. 8.

Figure 8:
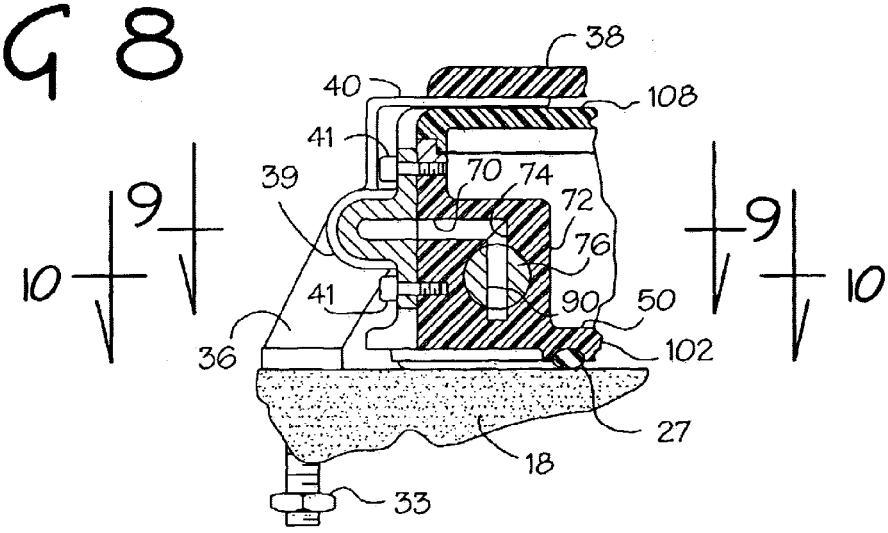
FIG. 8 is a section, on an enlarged scale, taken generally on line 8—8 in FIG. 2.
Figure 9:
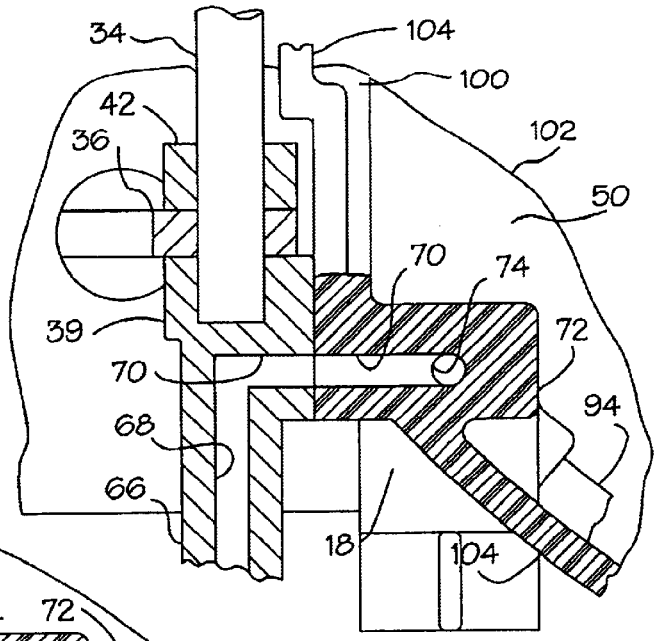
FIG. 9 is a section taken on line 9—9 in FIG. 8.
Figure 10:
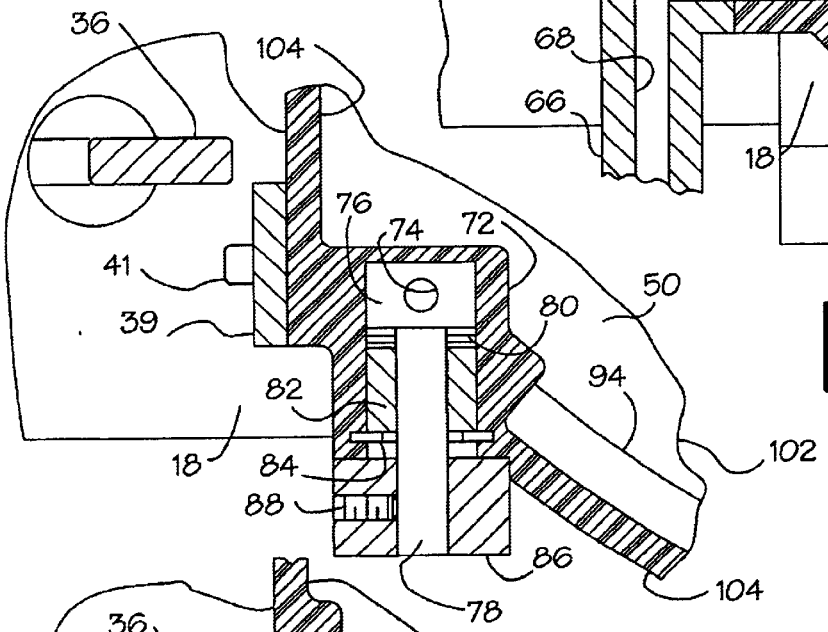
FIG. 10 is a section taken on line 10—10 in FIG. 8.

A valve member 76 is interposed in the passageway 74, intermediate its length (FIGS. 8, 9 and 10). The valve member 76 has a stem 78 that projects through a sealing member 80 and a bearing collar 82 to the exterior of the seat. This valve assembly may be secured in place by a snap ring 84. A valve actuating lever 86 is then secured to the outer end of the valve stem 78 by a screw 88. The valve member 76 has a transverse hole 90 which is registered with the vertical passageway 74 when the valve member is pivoted to its open position illustrated in FIGS. 8 and 9. The valve member 76 may be pivoted approximately 40 degrees to a closed position in which flow of water is blocked.

Figure 11:
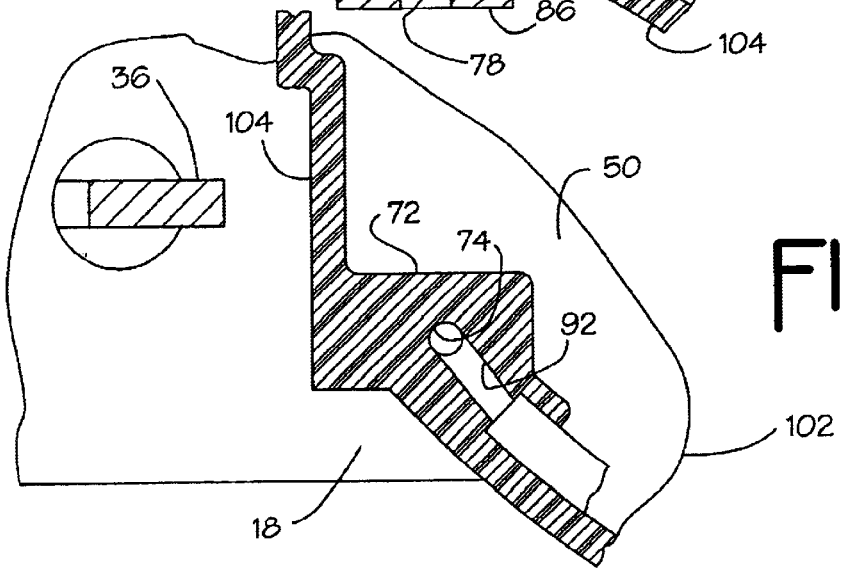
FIG. 11 is a section through a portion of the toilet seat, on a line below line 10—10 in FIG. 8 and illustrating a water flow line also seen in FIG. 2.

The lower end of the passageway 74 communicates with a lateral passageway 92 (FIG. 11) and a flexible tube 94, which extends underneath the air freshener unit 56 (FIGS. 2 and 7) and the entrainment separator 49 to a nozzle mounting bracket 96, which may be molded integrally with the seat 26. The bracket 96 has supporting legs 97 (FIG. 6) for a cradle 99 in which the nozzle 44 may be removably mounted (permitting cleaning or replacement). The bracket 96 also has an internal passageway that directs pressurized water from the tube 94 to the nozzle 44. A similar mounting bracket 96' is provided for removably mounting the second nozzle 44. A flexible hose 98 then provides a pressurized water connection from the bracket 96 to the bracket 96'. Passageways in the latter then feed the pressurized water to the second nozzle 44.

The described water supply system has several advantageous features. It provides a very simple and readily accessible means for activation of the malodor control system, as a person can easily reach the lever 86 and pivot it from its normally closed position to its open position.

Another advantage of the described water supply system is that the conventional ability to pivot the seat to a raised position is preserved, without introducing a potential for leakage.

Perhaps most important, the water supply system contributes to the ability to retrofit the toilet seat of the present invention as a substitute for conventional seats. This is to point out that the seat 26, lid 38 and supports 36, connected to the pivot pin 34, may be packaged and sold as a pre-assembled unit in the same fashion as conventional seat/lid units. The supports are adapted to be mounted in the same holes as are provided for conventional seat/lid assemblies. There remains only to provide a connection with the water pipe which had previously supplied water to the water tank of the toilet. This is a simple task, involving only the installation of the T-connection 60 and the connection of the tank supply pipe 62 (a flexible tube could also suffice) thereto, along with the flexible tube 64, all of which would be within the capabilities of a vast majority of "do-it-yourselfers".

Figure 12:
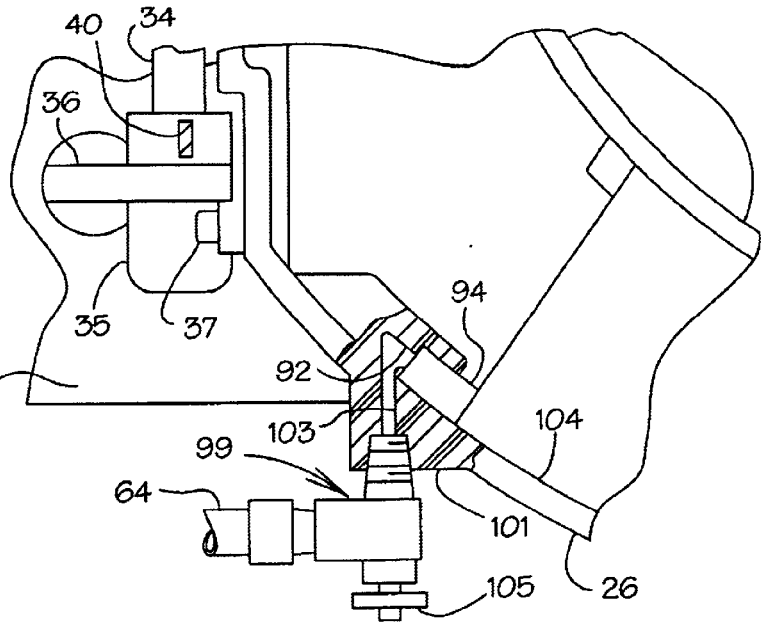
FIG. 12 is a section taken on line 12—12 in FIG. 13, with portions broken away and in section.
Figure 13:
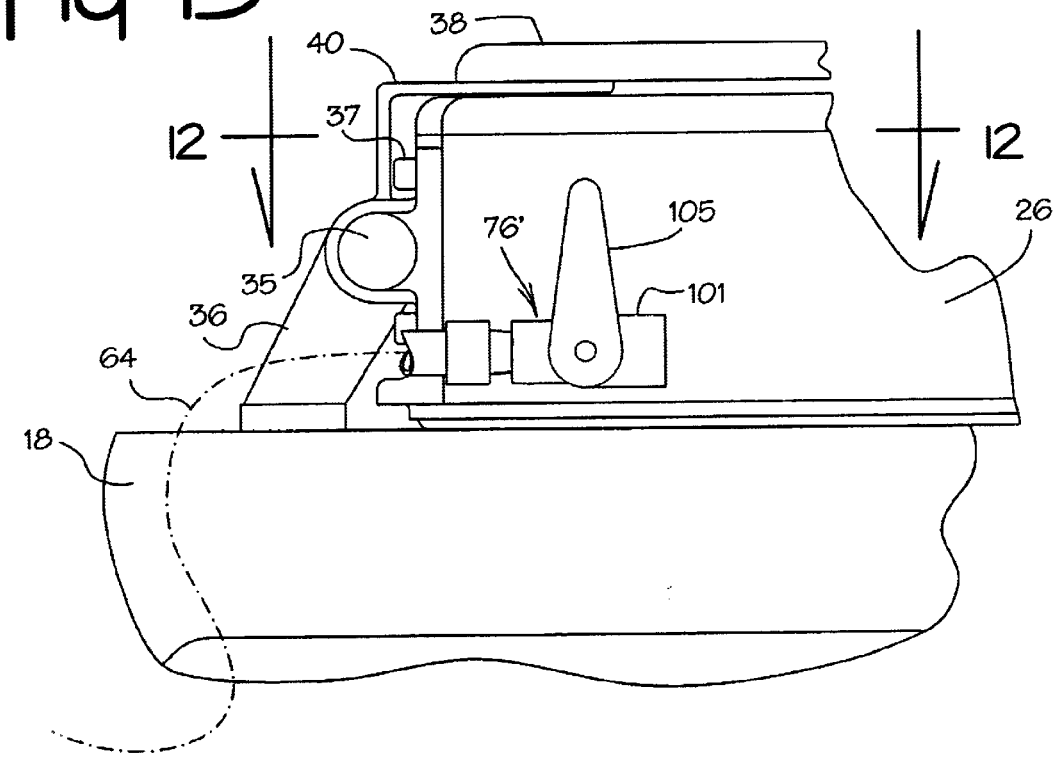
FIG. 13 is an elevation illustrating an alternate valve construction for controlling flow of water employed in the malodor control system.

It is to be understood that, within the broader aspects of the invention, the flexible water line 64 could be connected directly to the seat 26 to provide a fluid connection with the valve inlet passageway 70. Additionally, an alternate valve construction could be employed as illustrated in FIGS. 12 and 13. There, a commercially available valve ι' is provided for controlling flow of water to the nozzles 44. This valve is threadably mounted on a boss 101 that is formed integrally with the seat wall 104. Water supply line 64, extending from a source of pressurized-water, as before described, is connected to a rearwardly-directed inlet port of the valve 76'. The valve 76' then has an outlet port that is in communication to a passageway 103, which, in turn is in fluid communication, by way of passageway 92, with the tube 94 to supply water to the nozzles 44. A valve lever 105 may be rotated between open and closed positions to permit manual control of the malodor control system.

Using this exterior valve then permits simplification of the hinge for seat 26 in that the near end of the seat can be the same as the far end of the seat. Thus the near end of the seat can be mounted on the pin 34 by a bracket 35, instead of the bracket 39 which included the pressurized water connection. Otherwise the hinge mounting for the seat 26 is the same as previously described. This modified seat construction can also be retrofitted on existing toilets in the same fashion previously described.

It has already been pointed out that the bottom wall of the hollow seat 26 slopes downwardly from the front of the seat to the rear of the seat, in order to assure drainage of water from the seat and its return to the toilet bowl 18. The entrainment separator 49 is configured to facilitate such drainage by being free of pockets or recesses which would prevent the free flow of water in a rearward direction for drainage through the discharge opening 52. The air freshener unit 56 is also configured for the free flow of water therethrough for return to the toilet bowl by way of the discharge opening 52.

In connection with return of odor absorbing water to the toilet bowl, it is also to be noted that a lip 100, disposed below the air discharge opening 48, projects inwardly from the rear wall of the seat of the hollow seat 26 (FIG. 3). This lip functions as a dam to prevent water from splashing onto the exterior of the bowl, or onto the floor, in the event the seat is pivot to its up position before water has had a chance to completely drain back into the bowl, through the discharge opening 52.

The seat 26 is basically formed as a two piece construction to provide the referenced hollow construction, which defines the dual air purification paths. Thus there is a lower seat member 102 comprising the bottom wall 50, a side wall 104 defining the outer and rear portions of the seat. A lower member side wall 106 then defines the central seat opening 30. A top seat member 108 is mounted on the lower seat member 102 and forms the top wall of the hollow seat chamber. The seat members are preferably joined, by a friction fit, or otherwise, in such a manner as will permit the ready removal of the top seat member 102. The removable feature provides access to the interior to the seat for maintenance purposes. It is specifically contemplated that the air freshener unit 56 may be in the form of a replaceable cartridge. Additionally, it may well be desirable, or necessary, to clean or replace the nozzles 44 or to clean the entrainment separators 49.

It will be observed that the entrainment separator 49 is positioned between a pair of lugs 110, 112, and the air freshener unit 56 is positioned between the lug 112 and a third lug 114. Replacement air freshener units, proportioned to inserted between these lugs, can thus be readily positioned when the top seat member 108 is removed.

Another preferred aspect in the configuration of the seat 26 is found in maximizing the rate of fouled air flow. This flow rate is a function of velocity and volume of water flow. Fouled air flow rate is also a direct function of cross sectional area of the fouled air flow path. It is for this reason that the seat 26 preferably has a height substantially greater than the usual toilet seat. The overall height of the seat 26 will be a function of the needed dimensions for defining the fouled air passage, plus the thickness of the walls which define the fouled air passage, the wall thickness in turn being a function of the physical properties of the material of which the seat is formed. For economical reasons, it is contemplated that the seat will be formed from some form of resinous material. In any event, it has been found that minimum flow area, at least in the region of the nozzles 44 should be at least in the approximate order of 6.25 square inches. It is further preferred, that there be a single nozzle for each fouled air flow path and that the height of the flow path approximate the width of the flow path to better conform the conical spray pattern.

SUMMARY OF OPERATION

When a person sitting on the seat 26 desires to initiate operation of the present malodor control system, the lever 86 (or the lever 105, FIG. 13) is rotated so that water will be discharged from the nozzles 44. Fouled air will be drawn through openings 46 following flow paths indicated in FIG. 2 by arrows "a" and "b". The water sprays from nozzles 44 will absorb the greater part, if not all of the unpleasant odor. The air may then be further processed through the air freshener units 56, after passing through the entrainment separators 49. The purified air from the two flow paths is then discharged through the rear opening 48, as the precipitated spray water flows back into the toilet bowl 18, through opening 52.

It will also be noted that it would be possible for the front end of the toilet seat 26 be open. This is to say that the toilet seat 26 could have a "U" shaped outline as opposed to the closed ovate outline disclosed. If this conventional, alternate seat construction were adopted, it would be preferable to maintain the free ends of the "U" is closely proximate relation in order to maximize the inducing of fouled air through the inlet openings 46. This and other variations from the disclosed embodiment will occur to those skilled in the art, therefore the scope and limits of the present invention are to be determined from the following claims.

Having thus disclosed the invention, what is claimed as novel and desired to be secured by Letters Patent of the United States is:

1. A toilet comprising an upwardly open bowl having an opening through which the products of human elimination are received, a seat mounted on said bowl and having an opening generally aligned with said bowl, said seat, said bowl and portion's of the body of a person sitting on the seat, forming a chamber, and a malodor control system comprising means for defining a fluid flow path within said seat, said flow path having an inlet opening from the chamber thus formed to said flow path, and an air outlet through which air is discharged from the flow path to the exterior of said seat, characterized by a water spray nozzle disposed in said fluid flow path between inlet opening and said air outlet, whereby water discharged from said spray nozzle will induce fouled air from the bowl into said flow path, and malodor will be absorbed by the water spray and air substantially free of stench will be discharged through said air outlet, and further characterized in that the fluid flow path has a water discharge opening from a lower portion of the flow path into the upwardly open bowl, whereby water from the spray nozzle is returned to the bowl.

2. A toilet as in claim 1 further characterized by an entrainment separator, disposed in said flow path and spaced downstream from said nozzle, for precipitating water from air flowing through said flow path, and also characterized in that the water discharge opening is downstream of said entrainment separator.

3. A toilet as in claim 2, further characterized by an air freshener unit disposed in said flow path down stream of said entrainment separator.

4. A toilet as in claim 2 having means for mounting said seat for pivotal movement between a down position in which the seat is resting on said bowl and an up position in which the seat is swung rearwardly of the bowl opening, and further characterized by means for supplying water to said nozzle, including a flexible water line connecting a rear portion of the seat to a fixed source of pressurized water.

5. A toilet as in claim 4 further characterized in that the means for supplying water include valve means mounted on said seat for controlling flow of water to said nozzle.

6. A toilet as in claim 5 further characterized in that the seat has water a water inlet passage and a water discharge passage leading to the spray nozzle, and the valve means include a flow controlling valve member mounted in said seat intermediate said water inlet and discharge passages.

7. A toilet as in claim 4, wherein the means for mounting the seat include a bracket secured to a rear portion of the seat, and further characterized in that said bracket has an extension aligned with the axis of pivotal movement and projecting laterally from the seat, and the means for supplying water include a passageway extending lengthwise of said bracket extension and said flexible tube is secured to said extension and in fluid communication with the lengthwise extending passageway.

8. A toilet as in claim 7 further characterized in that the means for supplying water include valve means mounted on said seat and having an open position in which water:

flows to the nozzle and a closed position in which flow of water to the nozzle is shut off, and manually operable means, disposed at a rear lateral position relative to said seat, for shifting said valve means between its open and closed positions.

9. A toilet as in claim 2 further characterized in that the cross sectional area of said fluid flow path, immediately downstream of the nozzle approximates at least, about 6.25 square inches.

10. A toilet comprising an upwardly open bowl having a horizontal rim peripherally of its opening through which the products of human elimination received, a hollow seat mounted on said bowl and having an opening generally aligned with said bowl, said seat, said bowl and portions of the body of a person sitting on the seat, forming a chamber, and a malodor control system comprising a pair of water spray nozzles disposed within the hollow seat, respectively, on opposite lateral sides thereof, inlet means formed in said hollow seat, upstream of said nozzles, for placing the interior of the seat into communication with the chamber thus formed upstream of said spray nozzles, an air outlet means formed in said seat downstream of said spray nozzles, for placing its hollow interior in communication with ambient air exteriorly of said chamber, water discharge means formed in a bottom wall portion of the seat, downstream of the nozzles for placing its hollow interior in communication with said chamber to return water from the spray nozzles into said bowl.

11. A toilet as in claim 10 further comprising an entrainment separator disposed downstream of each nozzle and upstream of the air discharge means and also upstream of the water discharge means.

12. A toilet as in claim 11 further characterized in that interior cross sectional area of the hollow seat, immediately downstream of the nozzles at least approximates about 6.25 square inches.

13. A toilet as in claim 11 further comprising an air freshener unit disposed intermediate each entrainment separator and the air discharge means and the water discharge means.

14. A toilet as in claim 13 further comprising means for mounting one end of said seat for pivotal movement between a down position in which the seat is resting on said bowl and an up position in which the seat is swung rearwardly of the bowl opening, and wherein the nozzles are each disposed to discharge a water spray toward the pivotally mounted end of the seat, the water discharge means comprise an opening formed in the bottom wall of the seat at the pivotally mounted end thereof, and the upper surface of the bottom wall of the seat is sloped downwardly from said spray nozzles to said water discharge means to assure drainage of water from the seat.

15. A toilet as in claim 14 further characterized in that a rear portion of the seat overlies the bowl opening, and the bottom wall of the seat has a tubular portion projecting downwardly from the overlying portion of the seat and defining the hole of the water discharge means.

16. A toilet as in claim 13 wherein the seat is compositely formed by a lower portion and an upper portion removably secured to the lower portion, and the air freshener units are replaceable when the upper seat portion is removed from the lower seat portion.

17. A toilet as in claim 11 wherein the the seat is compositely formed by a lower portion and an upper portion removably secured to the lower portion, and further comprising means, connected to the lower seat portion, for mounting said seat for pivotal movement between a down position in which the seat is resting on said bowl and an up position in which the seat is swung rearwardly of the bowl opening, and further wherein the nozzles are disposed toward the free end of the seat and directed generally toward the mounting means.

18. A toilet as in claim 17 further characterized by sealing means mounted on the undersurface of the seat and engagable with said rim peripherally of the bowl opening to assure a fluid seal at the juncture of these chamber defining components.

19. A toilet as in claim 17 further characterized in that the means for pivotally mounting the seat comprise a horizontal shaft disposed rearwardly of the bowl opening in spaced relation above the horizontal rim, a pair of laterally spaced supports mounted on said bowl, a pair of brackets, secured to the lower portion of the seat and pivotally mounted on opposite ends of the shaft, outboard of the supports, means for supplying water including an extension projecting from one of said brackets generally axially of said shaft, a passageway extending lengthwise of said bracket extension, a flexible tube secured at one end to said extension in fluid communication with the lengthwise extending passageway and at its other end in communication with a supply of pressurized water, valve means mounted on said lower seat portion and having an open position in which water flows to the nozzles and a closed position in which flow of water to the nozzles is shut off, and manually operable means, disposed at a rear lateral position relative to said seat, for shifting said valve means between its open and closed positions.

* * * * *